US010955781B2

(12) United States Patent
Murakami et al.

(10) Patent No.: US 10,955,781 B2
(45) Date of Patent: Mar. 23, 2021

(54) FIXING APPARATUS, IMAGE FORMING APPARATUS, AND NIP WIDTH CONTROLLING METHOD

(71) Applicant: Konica Minolta, Inc., Tokyo (JP)

(72) Inventors: Masanori Murakami, Aichi (JP); Takashi Yamada, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/705,103

(22) Filed: Dec. 5, 2019

(65) Prior Publication Data

US 2020/0192252 A1 Jun. 18, 2020

(30) Foreign Application Priority Data

Dec. 14, 2018 (JP) ..... JP2018-234085

(51) Int. Cl.
*G03G 15/20* (2006.01)

(52) U.S. Cl.
CPC ..... *G03G 15/205* (2013.01); *G03G 15/2053* (2013.01); *G03G 15/2064* (2013.01)

(58) Field of Classification Search
CPC ..... G03G 15/205; G03G 15/2039; G03G 15/2064; G03G 15/2053; G03G 15/2028; G03G 2215/2035
See application file for complete search history.

(56) References Cited

U.S. PATENT DOCUMENTS

2007/0217841 A1* 9/2007 Fujii ..... G03G 15/2039 399/341
2010/0226700 A1* 9/2010 Yamada ..... G03G 15/2039 399/329
2010/0239295 A1* 9/2010 Mikutsu ..... G03G 15/2028 399/68
2011/0170891 A1* 7/2011 Inoue ..... G03G 15/2039 399/67
2014/0153938 A1* 6/2014 Saito ..... G03G 15/2053 399/33

FOREIGN PATENT DOCUMENTS

JP 2017-097183 A 6/2017

* cited by examiner

*Primary Examiner* — Walter L Lindsay, Jr.
*Assistant Examiner* — Jessica L Eley
(74) *Attorney, Agent, or Firm* — Squire Patton Boggs (US) LLP

(57) ABSTRACT

A fixing apparatus, an image forming apparatus, and a nip width controlling method, capable of preventing deterioration in fixing quality by controlling the nip width with high accuracy, are provided. The fixing apparatus includes a pair of fixing members that are in pressure-contact with each other and in which at least one of the members rotates to thereby form a fixing nip that sandwiches and conveys a recording medium; a moving section that moves the pair of fixing members relative to each other in a direction in which the pair of fixing members are brought into pressure-contact with each other or in a direction opposite thereto; a detector that detects rotational torque for rotating any one of the pair of fixing members; and a control section that controls the moving section such that the pair of fixing members are moved relative to each other corresponding to the detected rotational torque.

17 Claims, 13 Drawing Sheets

| | LENGTH (mm) | TARGET ROTATIONAL TORQUE (N·m) |
|---|---|---|
| K2 | 332 | 0.12 |
| N3 | 235 | 0.17 |
| N4 | 205 | 0.19 |
| Y4 | 105 | 0.21 |

FIXING APPARATUS, IMAGE FORMING APPARATUS, AND NIP WIDTH CONTROLLING METHOD

CROSS REFERENCE TO RELATED APPLICATIONS

The entire disclosure of Japanese patent Application No. 2018-234085 filed on Dec. 14, 2018, is incorporated herein by reference in its entirety.

BACKGROUND

Technological Field

The present invention relates to a fixing apparatus, an image forming apparatus, and a nip width controlling method.

Description of Related Art

In general, in an image forming apparatus (printer, copier, facsimile machine, or the like) utilizing an electrophotographic process technology, a laser beam based on image data is radiated to a charged photosensitive drum (light exposure), whereby an electrostatic latent image is formed on the surface of the photoconductor. Then, when toner is supplied from the developing device to the photosensitive drum on which the electrostatic latent image is formed, the electrostatic latent image is visualized and a toner image is formed. The toner image is transferred to a sheet directly or indirectly via an intermediate transfer belt, and then it is heated and pressurized by the fixing apparatus, whereby an image is formed on the sheet.

The fixing apparatus includes a fixing surface side member disposed on the fixing surface (surface on which a toner image is formed) side of a sheet, a rear surface side supporting member disposed on the rear surface (surface opposite to the fixing surface) side of a sheet, a heat source, and the like. In general, when a pressure roller constituting the fixing surface side member and a pressure roller constituting the rear surface side supporting member are in pressure-contact with each other directly or indirectly, a fixing nip that sandwiches and conveys a sheet is formed.

The outer peripheral surface of the pressure roller (also referred to as a fixing member) constituting each of the fixing surface side member and the rear surface side supporting member is made of an elastic layer such as rubber. For example, the surface hardness of one pressure roller is lower than the surface hardness of the other pressure roller. Thereby, when a pair of pressure rollers is brought into pressure-contact with each other, a pressure roller having a lower surface hardness is crushed, whereby a fixing nip is formed.

In order to cope with higher printing speed in recent years, it is necessary to increase the contact area between a sheet and a pressure roller. That is, it is necessary to increase the nip width. In order to increase the nip width for example, in the case of increasing the thickness of the elastic layer of the pressure roller, when the temperature of the pressure roller at the time of fixing rises, the thermal expansion of the pressure roller increases. Thereby, the change amount of the nip width increases, and if the nip width falls out of a predetermined range, the fixing quality may deteriorate.

For example, Japanese Patent Laid-Open No. 2017-97183 (Patent Literature 1) discloses a fixing apparatus including moving means that moves a pair of pressure rollers relative to each other, means that predicts a thermal expansion amount of a pressure roller on the basis of the temperature of the pressure roller, and a control section that controls the moving means so as to maintain the nip width within a predetermined range corresponding to the predicted thermal expansion amount of the pressure roller.

However, in the fixing apparatus disclosed in Patent Literature 1, since the thermal expansion amount of the pressure roller is predicted on the basis of the temperature of the pressure roller, there is a case where the difference between the actual thermal expansion amount and the predicted thermal expansion amount is large due to variations in the outer diameter and the hardness of the pressure rollers, for example. In that case, even if the moving means is controlled corresponding to the predicted thermal expansion amount of the pressure roller, the nip width cannot be controlled with high accuracy. This may cause deterioration in the fixing quality.

SUMMARY

An object of the present invention is to provide a fixing apparatus, an image forming apparatus, and a nip width controlling method that are capable of preventing deterioration in the fixing quality by controlling the nip width with high accuracy.

To achieve at least one of the abovementioned objects, according to an aspect of the present invention, a fixing apparatus reflecting one aspect of the present invention comprises:

a pair of fixing members, the pair of the fixing members being in pressure-contact with each other and at least one of the pair of the fixing members rotating to form a fixing nip, the fixing nip sandwiching and conveying a recording medium;

a mover that moves the pair of the fixing members relative to each other in a direction in which the pair of the fixing members are brought into pressure-contact with each other or a direction opposite to the direction in which the pair of the fixing members are brought into pressure-contact with each other;

a detector that detects rotational torque for rotating any one of the pair of the fixing members; and a hardware processor that controls the mover such that the pair of the fixing members are moved relative to each other corresponding to the detected rotational torque.

To achieve at least one of the abovementioned objects, according to an aspect of the present invention, an image forming apparatus reflecting one aspect of the present invention comprises: an image former that forms an image on a recording medium; and the fixing apparatus described above, that fixes the image formed by the image former on the recording medium.

To achieve at least one of the abovementioned objects, according to an aspect of the present invention, a nip width controlling method reflecting one aspect of the present invention is a method in a fixing apparatus having a pair of fixing members, the pair of the fixing members being in pressure-contact with each other and at least one of the fixing members rotating to form a fixing nip, the fixing nip sandwiching and conveying a recording medium, the method comprising:

detecting rotational torque for rotating any one of the pair of the fixing members; and moving the pair of the fixing members relative to each other in a direction in which the pair of the fixing members are brought into pressure-contact with each other or a direction opposite to the direction in which the pair of the fixing members are brought into pressure-contact with each other, corresponding to the rotational torque detected.

BRIEF DESCRIPTION OF DRAWINGS

The advantageous and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
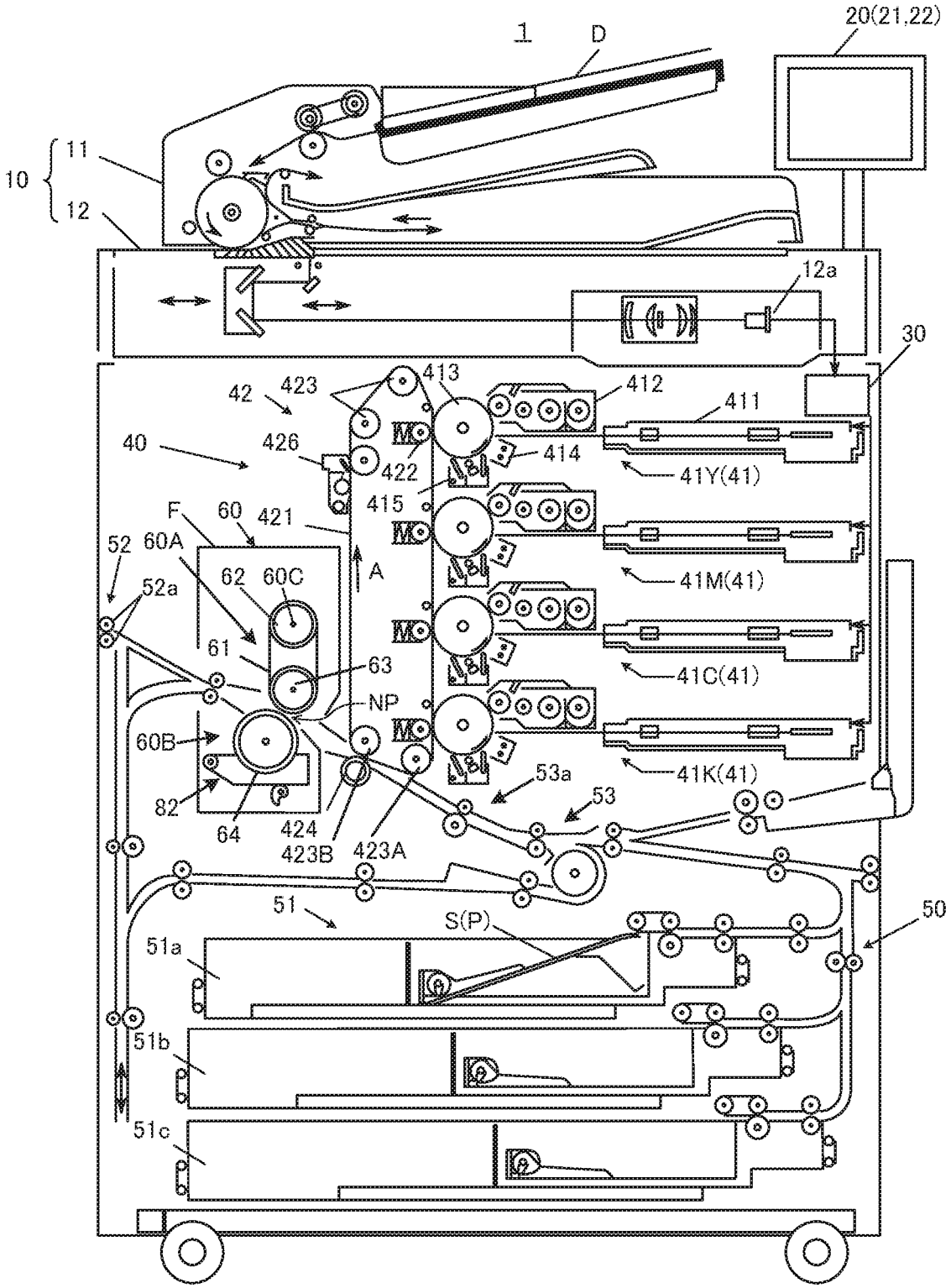
FIG. 1 schematically illustrates an apparatus according to an embodiment of the present invention.
Figure 2:
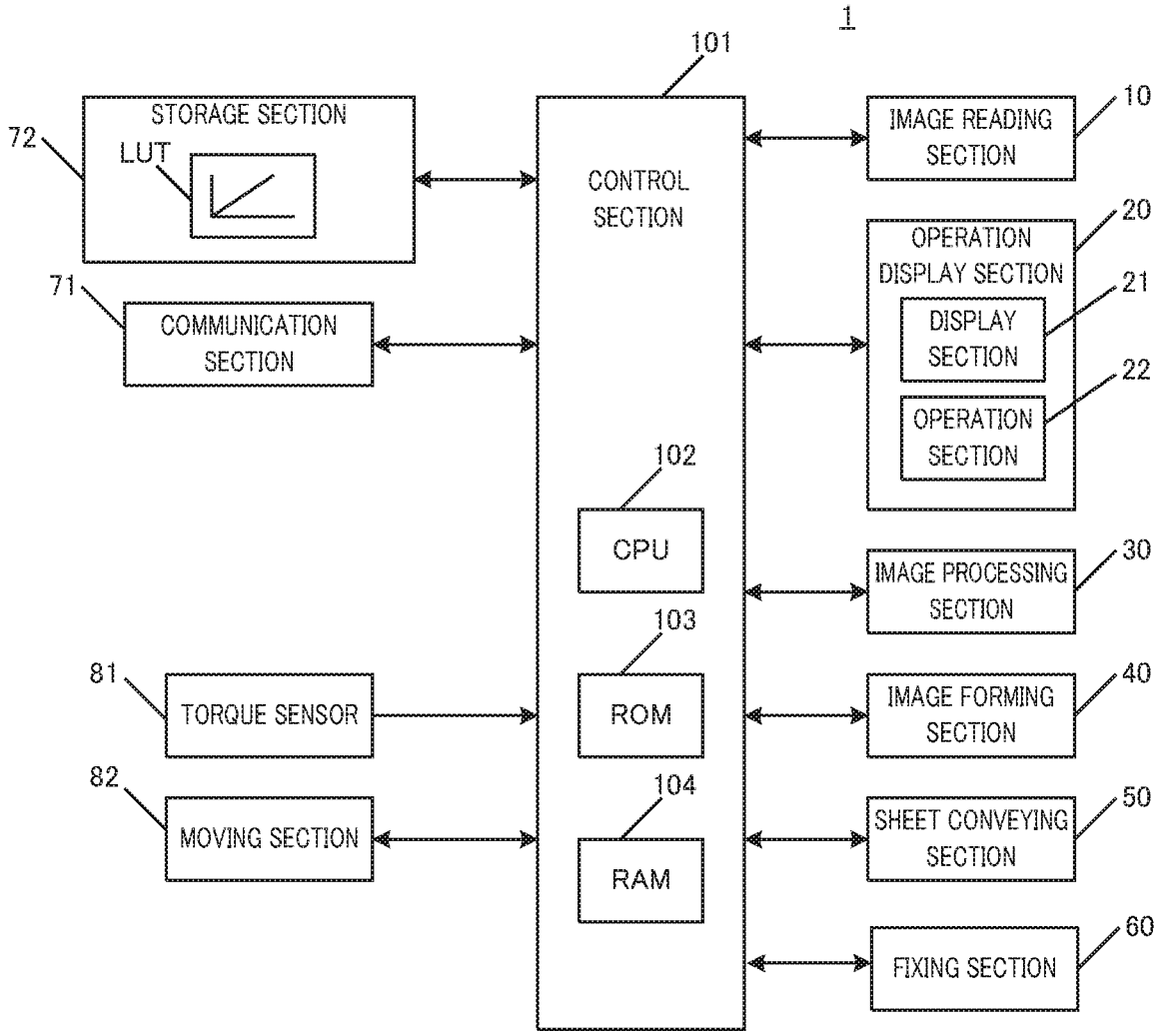
FIG. 2 is a diagram illustrating main sections of the control system of an image forming apparatus according to the present embodiment.

Hereinafter, an embodiment of the present invention will be described in detail with reference to the accompanying drawings. FIG. 1 schematically illustrates an overall configuration of image forming apparatus 1 according to an embodiment of the present invention. FIG. 2 illustrates main sections of the control system of image forming apparatus 1 according to the present embodiment. Image forming apparatus 1 illustrated in FIGS. 1 and 2 is a color image forming apparatus of an intermediate transfer system type utilizing electrophotographic process technology. That is, image forming apparatus 1 primarily transfers toner images of respective colors namely yellow (Y), magenta (M), cyan (C), and black (K), formed on photoconductor drum 413, onto intermediate transfer belt 421, and after the toner images of the four colors are superimposed on intermediate transfer belt 421, image forming apparatus 1 secondarily transfers them to sheet S (recording medium) to thereby form a toner image.

In image forming apparatus 1, a tandem method is adopted in which photoconductor drums 413 corresponding to the four colors of YMCK are disposed in series in the traveling direction of intermediate transfer belt 421, and the toner images of the respective colors are sequentially transferred onto intermediate transfer belt 421 through one procedure.

As illustrated in FIG. 2, image forming apparatus 1 includes image reading section 10, operation display section 20, image processing section 30, image forming section 40, sheet conveying section 50, fixing section 60, and control section 101.

Control section 101 includes central processing unit (CPU) 102, read only memory (ROM) 103, and random access memory (RAM) 104. CPU 102 reads a program corresponding to the processing content from ROM 103 and develops it in RAM 104, and controls operation of respective blocks of image forming apparatus 1 in a centralized manner in cooperation with the developed program. At this time, respective types of data stored in storage section 72 are referred to. For example, storage section 72 is made up of a non-volatile semiconductor memory (so-called flash memory) and a hard disk drive.

Control section 101 transmits and receives various types of data with an external device (for example, personal computer) connected to a communication network such as local area network (LAN), wide area network (WAN), or the like, via communication section 71. For example, control section 101 receives image data transmitted from an external device, and forms a toner image on sheet S on the basis of the image data (input image data). Communication section 71 is made up of a communication control card such as a LAN card.

Image reading section 10 includes auto document feeder (ADF) 11 and document image scanner 12.

Auto document feeder 11 conveys document D placed on a document tray by a conveying mechanism to send it to document image scanner 12. Auto document feeder 11 can sequentially read out images (including those on both sides) of a plurality of pieces of documents D, placed on the document tray, at once.

Document image scanner 12 optically scans a document conveyed onto the contact glass from auto document feeder 11 or a document placed on the contact glass, forms an image of reflected light from the document on the light receiving surface of charge coupled device (CCD) sensor 12*a*, and reads the document image. Image reading section 10 generates input image data on the basis of the readout result by document image scanner 12. On the input image data, predetermined image processing is performed by image processing section 30.

Operation display section 20 is made up of a liquid crystal display (LCD) with a touch panel, for example, and functions as display section 21 and operation section 22. Display section 21 displays various operation screens, image states, operating conditions of respective functions, and the like in accordance with display control signals input from control section 101. Operation section 22 includes various operation keys such as a numeric key pad and a start key, and receives various input operations by a user and outputs operation signals to control section 101.

Image processing section 30 includes a circuit to perform digital image processing corresponding to the initial setting or user setting, on the input image data. For example, image processing section 30 performs tone correction on the basis of tone correction data (tone correction table) under the control of control section 101. In addition to the tone correction, image processing section 30 also performs various types of correction processing such as color correction and shading correction, compression processing, and the like, on the input image data. On the basis of the image data on which such processing is performed, image forming section 40 is controlled.

Image forming section 40 includes image forming units 41Y, 41M, 41C, and 41K for forming images of respective color toners for Y components, M components, C components, and K components, on the basis of the input image data, and intermediate transfer unit 42.

Image forming units 41Y, 41M, 41C, and 41K for Y components, M components, C components, and K components each have the same configuration. For convenience of illustration and description, common constituent elements are denoted by the same reference sign, and the reference signs are shown with Y, M, C, or K for distinguishing them. In FIG. 1, only constituent elements of image forming unit 41Y for Y component are denoted by reference signs. Regarding the constituent elements of the other image forming units 41M, 41C, and 41K, reference signs are omitted.

Image forming unit 41 includes exposing device 411, developing device 412, photoconductor drum 413, charging device 414, and drum cleaning device 415.

Photoconductor drum 413 is a negative electrification-type organic photo-conductor (OPC) in which an under coat layer (UCL), a charge generation layer (CGL), and a charge transport layer (CTL) are sequentially layered on the peripheral surface of a conductive cylinder (aluminum element tube) made of aluminum, for example. The charge generation layer is formed of an organic semiconductor in which a charge generation material (for example, phthalocyanine pigment) is dispersed in a resin binder (for example, polycarbonate), and generates a pair of positive charge and negative charge with light exposure by exposing device 411. The charge transport layer is formed of a layer in which a hole transport material (electron donating nitrogen-containing compound) is dispersed in a resin binder (for example, polycarbonate resin), and transports a positive charge generated in the charge generation layer to a surface of the charge transport layer.

Control section 101 controls driving electric current supplied to a drive motor (not illustrated) that rotates photoconductor drum 413 to thereby rotate photoconductor drum 413 at a constant peripheral speed.

Charging device 414 uniformly electrifies the surface of photoconductor drum 413 having photoconductivity to the negative polarity. Exposing device 411 is formed of a semiconductor laser, for example, and emits laser beams corresponding to images of respective color components to photoconductor drum 413. When the positive charge is generated on the charge generation layer of photoconductor drum 413 and is transported to the surface of the charge transport layer, the surface charge (negative charge) of photoconductor drum 413 is neutralized. On the surface of photoconductor drum 413, an electrostatic latent image of each color component is formed by the potential difference from the surroundings.

Developing device 412 is a developing device of two-component developing system, for example, and forms a toner image by adhering respective color components on the surface of photoconductor drum 413 to visualize the electrostatic latent image.

Drum cleaning device 415 includes a drum cleaning blade to be in slide-contact with the surface of photoconductor drum 413, and removes transfer residual toner remaining on the surface of photoconductor drum 413 after the primary transfer.

Intermediate transfer unit 42 includes intermediate transfer belt 421, primary transfer roller 422, a plurality of support rollers 423, secondary transfer roller 424, and belt cleaning device 426.

Intermediate transfer belt 421 is made up of an endless belt, and is stretched in a loop shape on a plurality of support rollers 423. At least one of the support rollers 423 is formed of a drive roller, and the others are formed of driven rollers. For example, it is preferable that roller 423A disposed on the downstream side, in the belt traveling direction, of primary transfer roller 422 for K components is a drive roller. Thereby, the traveling speed of the belt in the primary transfer section is easily maintained constantly. When drive roller 423A rotates, intermediate transfer belt 421 travels at a constant speed in arrow A direction.

Primary transfer roller 422 is disposed on the inner peripheral side of intermediate transfer belt 421 so as to face photoconductor drums 413 of the respective color components. When primary transfer roller 422 is in pressure-contact with photoconductor drum 413 while sandwiching intermediate transfer belt 421, a primary transfer nip for transferring a toner image from photoconductor drum 413 to intermediate transfer belt 421 is formed.

Secondary transfer roller 424 is disposed on the outer peripheral surface of intermediate transfer belt 421 so as to face backup roller 423B disposed on the downstream side, in the belt traveling direction, of drive roller 423A. When secondary transfer roller 424 is in pressure-contact with backup roller 423B while sandwiching intermediate transfer belt 421, a secondary transfer nip for transferring a toner image from intermediate transfer belt 421 to sheet S is formed.

When intermediate transfer belt 421 passes through the primary transfer nip, the toner images on photoconductor drum 413 are primarily transferred to intermediate transfer belt 421 sequentially in a superimposed manner. Specifically, when primary transfer bias is applied to primary transfer roller 422 and charge of the opposite polarity to that of the toner is applied to the rear surface side (side to be in contact with primary transfer roller 422) of intermediate transfer belt 421, the toner images are electrostatically transferred to intermediate transfer belt 421.

Then, when sheet S passes through the secondary transfer nip, the toner image on intermediate transfer belt 421 is secondarily transferred to sheet S. Specifically, when secondary transfer bias is applied to secondary transfer roller 424 and charge of the opposite polarity to that of the toner is applied to the rear surface side (side to be in contact with secondary transfer roller 424) of sheet S, the toner image is electrostatically transferred to sheet S. Sheet S on which the toner image is transferred is conveyed toward fixing section 60.

Belt cleaning device 426 includes a belt cleaning blade to be in slide-contact with the surface of intermediate transfer belt 421, and removes transfer residual toner remaining on the surface of intermediate transfer belt 421 after the secondary transfer. Instead of secondary transfer roller 424, it is possible to adopt a configuration in which a secondary transfer belt is stretched in a looped manner on a plurality of support rollers including a secondary transfer roller (so-called belt-type secondary transfer unit).

Fixing section 60 includes upper fixing section 60A having a fixing surface side member disposed on the side of a fixing surface (surface on which a toner image is formed) of sheet S, lower fixing section 60B having a rear surface side supporting member disposed on the side of a rear surface (surface opposite to the fixing surface) of sheet S, and heat source 60C. When the rear surface side supporting member is in pressure-contact with the fixing surface side member, a fixing nip for sandwiching and conveying sheet S is formed. Fixing section 60 and control section 101 correspond to a fixing apparatus of the present invention.

When sheet S on which the toner image is secondarily transferred is conveyed to fixing section 60 is heated and pressed by the fixing nip, the toner image is fixed on sheet S by fixing section 60. Fixing section 60 is disposed as a unit in the fixing device, that is, casing F.

Sheet conveying section 50 includes sheet feed section 51, sheet ejection section 52, and conveyance path section 53. In three sheet feed tray units 51*a* to 51*c* constituting sheet feed section 51, sheets S (standard sheet, special sheet) identified according to the basis weight, size, and the like are stored by the preset type. Conveyance path section 53 includes a plurality of conveyance roller pair such as registration roller pair 53*a*.

Sheets S stored in sheet feed tray units 51*a* to 51*c* are sent one by one from the uppermost part and conveyed to image forming section 40 through conveyance path section 53. At this time, by the registration roller section in which registration roller pair 53*a* is disposed, inclination of fed sheet S is corrected and the conveyance timing is adjusted. Then, in image forming section 40, the toner images on intermediate transfer belt 421 are collectively secondarily transferred to one surface of sheet S, and a fixing process is performed by fixing section 60. Sheet S on which an image is formed is ejected to the outside of the apparatus by sheet ejection section 52 having sheet ejection roller 52*a*.

Next, the configuration of fixing section 60 will be described in more detail.

Upper fixing section 60A includes endless fixing belt 61 that is a fixing surface side member, heating roller 62, and upper pressure roller 63 (belt heating type). Fixing belt 61 is stretched with a predetermined belt tension (for example, 400N) on heating roller 62 and upper pressure roller 63.

Fixing belt 61 is configured such that the outer peripheral surface of the base body made of polyimide (PI), for example, is covered with heat-resistance silicon rubber as an elastic layer, and further, the surface layer is covered or coated with a tube of perfluoroalkoxy (PFA) that is heat-resistance resin.

Fixing belt 61 is brought into contact with sheet S on which a toner image is formed, and allows the toner image to be fixed on sheet S by heating within a fixing allowable temperature range. Here, the fixing allowable temperature range is a temperature that can supply a heat amount required for melting the toner on sheet S, which differs depending on the sheet type or the like of sheet S on which an image is to be formed.

Heating roller 62 heats fixing belt 61. Heating roller 62 incorporates therein heat source 60C that is a halogen heater, for example, that heats fixing belt 61. Heating roller 62 is configured such that the outer peripheral surface of a cylindrical core bar made of aluminum or the like is covered with a resin layer coated with PTFE.

The temperature of heat source 60C is controlled by control section 101. Heating roller 62 is heated by heat source 60C, and consequently, fixing belt 61 is heated.

Upper pressure roller 63 is one in which a solid core bar made of metal such as iron, for example, is covered with an elastic layer. As a material of the elastic layer, for example, heat-resistance silicon rubber can be used. Also, as an elastic layer, a configuration in which heat-resistance silicon rubber is covered with a resin layer coated with PTFE that is heat-resistant resin of low friction may be used.

Lower fixing section 60B includes lower pressure roller 64 constituting a rear surface side supporting member (roller pressure type). Lower pressure roller 64 is one in which the outer peripheral surface of a base material layer made of aluminum (Al) is covered with an elastic layer. As a material of the elastic layer, for example, heat-resistance silicon rubber can be used. Also, as an elastic layer, a configuration in which heat-resistance silicon rubber is covered with a resin layer of a PFA tube as a surface separation layer may be used.

Lower pressure roller 64 incorporates therein a heat source (not illustrated) such as a halogen heater. When the heat source generates heat, lower pressure roller 64 is heated. Control section 101 controls electric power to be supplied to the heat source, and controls lower pressure roller 64 to be a predetermined temperature.

Lower pressure roller 64 is in pressure-contact with upper pressure roller 63 at a predetermined fixing load via fixing belt 61. In this way, fixing nip NP for sandwiching and conveying sheet S is formed between upper pressure roller 63 and fixing belt 61, and lower pressure roller 64.

Lower pressure roller 64 is connected to an actuator not illustrated such as a motor or a gear, so that the driving force of the motor is transmitted to lower pressure roller 64. Control section 101 outputs a drive signal to the motor that drives lower pressure roller 64 to control peripheral speed of lower pressure roller 64.

In fixing section 60, upper fixing section 60A, lower fixing section 60B, and heat source 60C covey sheet S (recording medium) while heating and applying pressure thereto in fixing nip NP to thereby fix an unfixed toner image on sheet S.

Meanwhile, in order to cope with higher printing speed, it is necessary to increase the nip width. In order to increase the nip width, in the case of increasing the thickness of the elastic layers of pressure rollers 63 and 64 (fixing member), for example, when the temperature of pressure rollers 63 and 64 rises at the time of fixing, the thermal expansion of pressure rollers 63 and 64 also increases. Therefore, there is a problem that the amount of change of the nip width is increased and the nip width may fall out of a predetermined range.

In order to cope with this problem, a fixing apparatus is proposed in which thermal expansion of pressure rollers 63 and 64 is predicted on the basis of the temperature of pressure rollers 63 and 64, and a moving section is controlled so as to move a pair of pressure rollers 63 and 64 relative to each other corresponding to the expected thermal expansion of pressure rollers 63 and 64 to thereby change the nip width. With this configuration, due to variations in the outer diameter or hardness of pressure rollers 63 and 64, there is a possibility that the difference between the actual thermal expansion and the predicted thermal expansion increases so that the nip width cannot be controlled with high accuracy, and the fixing quality may be lowered.

Figure 3:
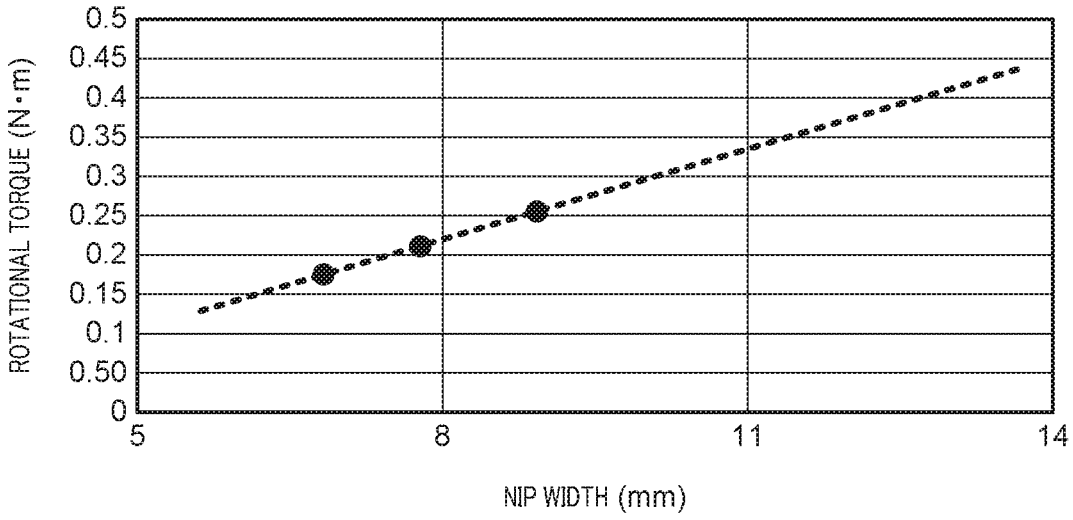
FIG. 3 illustrates a relationship between the nip width and the rotational torque in the envelope mode.

As described above, the amount of change of the nip width due to thermal expansion affects the fixing quality. The effect is larger in the case of allowing passage of an envelope in which sheets are doubled rather than the case of allowing passage of normal paper or thick paper, because shifting tends to occur between the doubled sheets, and consequently, wrinkle or the like tends to be generated. FIG. 3 illustrates a relationship between the nip width and the rotational torque for rotating lower pressure roller 64 (hereinafter simply referred to as "rotational torque") in the envelope mode for allowing, as a recording medium, an envelope in which two sheets are superimposed and bonded to pass through fixing section 60. In FIG. 3, the horizontal axis shows the nip width (mm) and the vertical axis shows the rotational torque (N·m). As illustrated in FIG. 3, the nip width and the rotational torque are in a proportional relationship. Note that while FIG. 3 shows that the nip width and the rotational torque are in a proportional relationship in the envelope mode, the nip width and the rotational torque are also in a proportional relationship even when normal paper is used as a recording medium (normal mode), like the envelope mode.

Therefore, in view of the fact that the nip width and the rotational torque are in a proportional relationship, fixing section 60 of the present embodiment includes torque sensor 81 that detects rotational torque (corresponding to "detector" of the present invention) and moving section 82. Control section 101 controls moving section 82 corresponding to the rotational torque detected by torque sensor 81.

Figure 4:
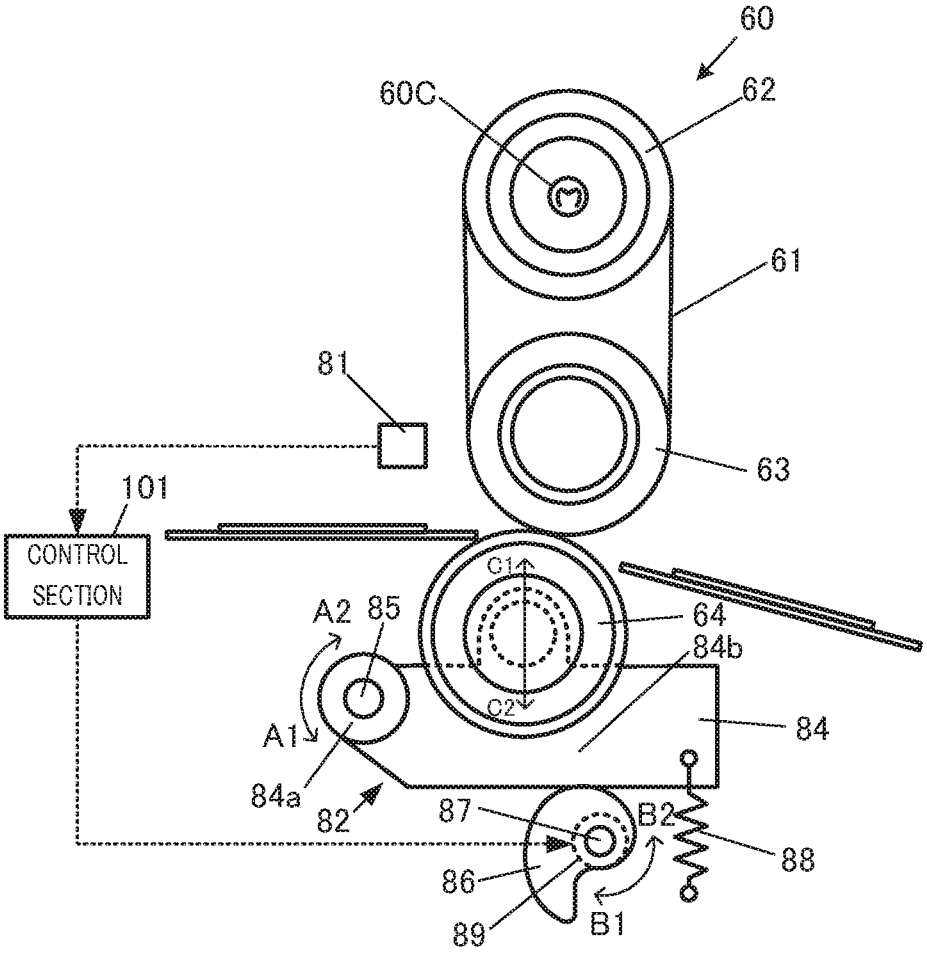
FIG. 4 schematically illustrates an example of a fixing section.

FIG. 4 schematically illustrates an example of fixing section 60 in the present embodiment. Torque sensor 81 is configured to detect rotational torque of the roller driving motor by detecting, by a current sensor, an electric current value flowing to the roller driving motor (not illustrated) that drives lower pressure roller 64, for example. Note that the torque sensor that detects rotational torque of the roller driving motor is not limited to a current sensor but may be formed of a publicly-known torque sensor such as distortion sensor, for example.

Moving section 82 moves upper pressure roller 63 and lower pressure roller 64 relative to each other in a direction in which they are brought into pressure-contact with each other or a direction opposite to the pressure-contact direction.

Moving section 82 includes arm member 84, cum member 86, tension spring 88, and cum driving motor 89.

Arm member 84 supports lower pressure roller 64 in a rotatable manner. Arm member 84 extends in a right and left direction in FIG. 4. Arm member 84 is displaceable in the directions of arrows A1 and A2 in the figure by pivot 85 provided to one end 84*a* in the extending direction. Below the other end 84*b* in the extending direction of arm member 84, cum member 86 is disposed.

Cum member 86 is an eccentric cum having a circumference and rotational axis 87 at a position deviated from the center of the circumference. Cum member 86 is rotationally driven in the directions of arrows B1 and B2 in the figure by cum driving motor 89. Cum driving motor 89 is a servo motor that is controlled by control section 101 such that a difference between the target rotation angle of the motor shaft and the detection angle of the motor shaft to be fed back becomes zero, for example. Note that direction B1 represents a direction from the rotation start position to the rotation end position, and direction B2 represents a direction from the rotation end position to the rotation start position.

Tension spring 88 maintains the other end 84*b* in the extending direction of arm member 84 in a state of being in contact with the circumference of cum member 86 by the tension thereof.

When cum member 86 is rotationally driven in the direction of arrow B1 in the figure by cum driving motor 89, arm member 84 is displaced in the direction of arrow A1 in the figure. Thereby, lower pressure roller 64 supported by the arm member moves in the direction of arrow C1 in the figure, that is, the direction of being brought into pressure-contact with upper pressure roller 63. Thereby, the force of pressure-contact between upper pressure roller 63 and lower pressure roller 64 is increased and the nip width is increased. Consequently, the rotational torque of lower pressure roller 64 can be increased.

On the other hand, when cum member 86 is rotationally driven in the direction of arrow B2 in the figure by cum driving motor 89, arm member 84 is displaced in the direction of arrow A2 in the figure. Thereby, lower pressure roller 64 supported by arm member 84 moves in the direction of arrow C2 in the figure, that is, the direction opposite to the direction of being brought into pressure-contact with upper pressure roller 63. Thereby, the force of pressure-contact between upper pressure roller 63 and lower pressure roller 64 is decreased and the nip width is narrowed. Consequently, the rotational torque of lower pressure roller 64 can be decreased.

Control section 101 controls moving section 82 corresponding to the rotational torque. Specifically, on the basis of the rotational torque detected by torque sensor 81, control section 101 controls cum driving motor 89 corresponding to the rotational torque, with reference to a relationship table (not illustrated) showing the relationship between the rotational torque and the rotational angle of the motor shaft of cum driving motor 89. Note that the relationship table is stored in ROM 103, for example.

When the rotational torque detected by torque sensor 81 is less than the target value, control section 101 controls cum driving motor 89 so as to rotationally drive cum member 86 in direction B1. Thereby, the rotational torque is increased to reach the target value. On the other hand, when the rotational torque detected by torque sensor 81 exceeds the target value, control section 101 controls cum driving motor 89 so as to rotationally drive cum member 86 in direction B2. Thereby, the rotational torque is decreased to be the target value. Here, the target value may be a predetermined numerical value or a predetermined numerical value range.

Figure 5:
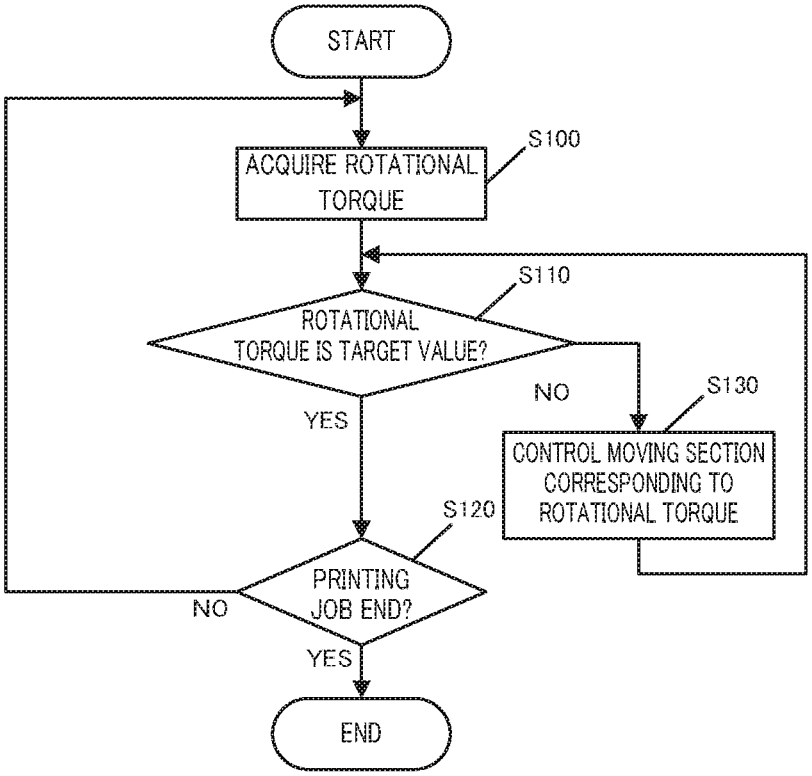
FIG. 5 is a flowchart illustrating an example of a nip width controlling method of the present embodiment.

Next, a nip width controlling method of the present embodiment will be described. FIG. 5 is a flowchart showing an example of a nip width controlling method of the present embodiment. This flow is realized by execution of a program recorded on ROM 103 by CPU 102 of control section 101.

First, at step S100, control section 101 acquires the rotational torque of lower pressure roller 64 detected by torque sensor 81.

Next, at step S110, control section 101 determines whether or not the rotational torque is at a target value. When the rotational torque is at the target value (step S110: YES), the processing proceeds to step S120. When the rotational torque is not at the target value (step S110: NO), the processing proceeds to step S130.

Next, at step S120, control section 101 determines whether or not the printing job has ended. When the printing job has ended (step S120: YES), the processing ends. When the printing job has not ended (step S120: NO), the processing returns to the process before step S100.

At step S130, control section 101 controls moving section 82 corresponding to the rotational torque. Specifically, when the rotational torque exceeds the target value, control section 101 rotationally drives cum member 86 in direction B2 to thereby control cum driving motor 89 to decrease the rotational torque to become the target value. Meanwhile, when the rotational torque is less than the target value, control section 101 rotationally drives cum member 86 in direction B1 to thereby control cum driving motor 89 to increase the rotational torque to become the target value. Then, the processing returns to the process before step S110.

Fixing section 60 of the present embodiment includes torque sensor 81 that detects rotational torque, moving section 82 that moves upper pressure roller 63 and lower pressure roller 64 in a direction in which they are brought into pressure-contact with each other or a direction opposite to the pressure-contact direction, and control section 101 that controls moving section 82 such that upper pressure roller 63 and lower pressure roller 64 moves relative to each other corresponding to the rotational torque detected by torque sensor 81. Thereby, since the nip width can be controlled with high accuracy corresponding to the rotational torque, it is possible to suppress degradation of the fixing quality.

(Modification 1)

Next, modifications of the present embodiment will be described. Note that in the description of the modifications, a configuration different from that of the embodiment described above will be mainly described. The same configuration will be denoted by the same reference sign and the description thereof will be omitted.

In Modification 1, fixing section 60 in the envelope mode will be described. In the envelope mode, when the nip width exceeds a predetermined range, a difference in the peripheral speed is caused between upper pressure roller 63 and lower pressure roller 64, which causes a difference in the conveying speed between the two. As a result, wrinkle or image deviation may occur on the envelope after the fixing process. That is, in the envelope mode, it is necessary to convey the envelope with a nip width of the level that upper pressure roller 63 and lower pressure roller 64 are not crushed so much. As described above, in a state where fixing belt 61 and lower pressure roller 64 are slightly in pressure-contact with each other, the crushed amount of upper pressure roller 63 and lower pressure roller 64 with respect to thermal expansion is larger, compared with the state where upper pressure roller 63 and lower pressure roller 64 are in pressure-contact with each other in some extent via fixing belt 61. Therefore, an effect of thermal expansion largely affects the nip width.

Figure 6:
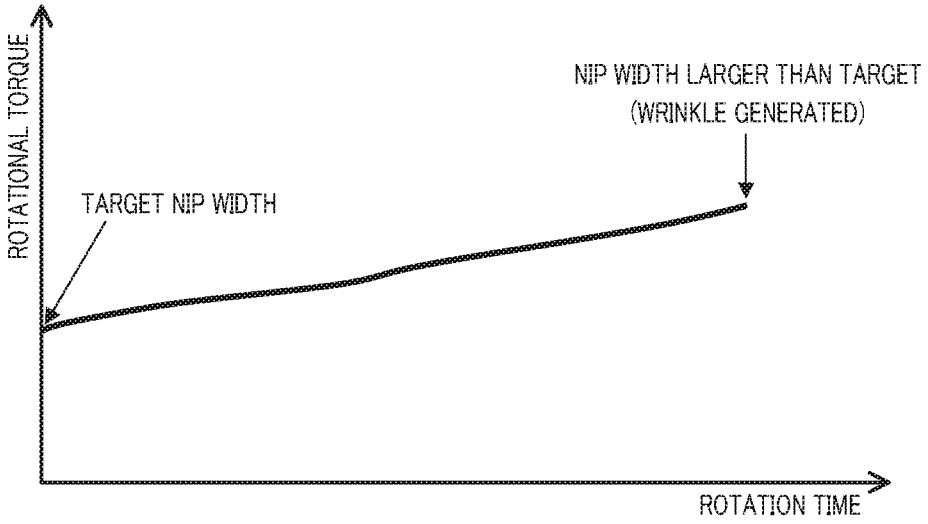
FIG. 6 illustrates a relationship between the rotation time of a lower pressure roller and the rotational torque.

FIG. 6 illustrates a relationship between the rotation time of lower pressure roller 64 and the rotational torque. In FIG. 6, the horizontal axis shows rotation time (t) of lower pressure roller 64, and the vertical axis shows rotational torque (N·m). As illustrated in FIG. 6, as the rotation time of lower pressure roller 64 has passed (as fixing section 60 is heated), the nip width is increased and the rotational torque is also increased. This means that an effect of thermal expansion of upper pressure roller 63 and lower pressure roller 64 largely affects the nip width.

Figure 7:
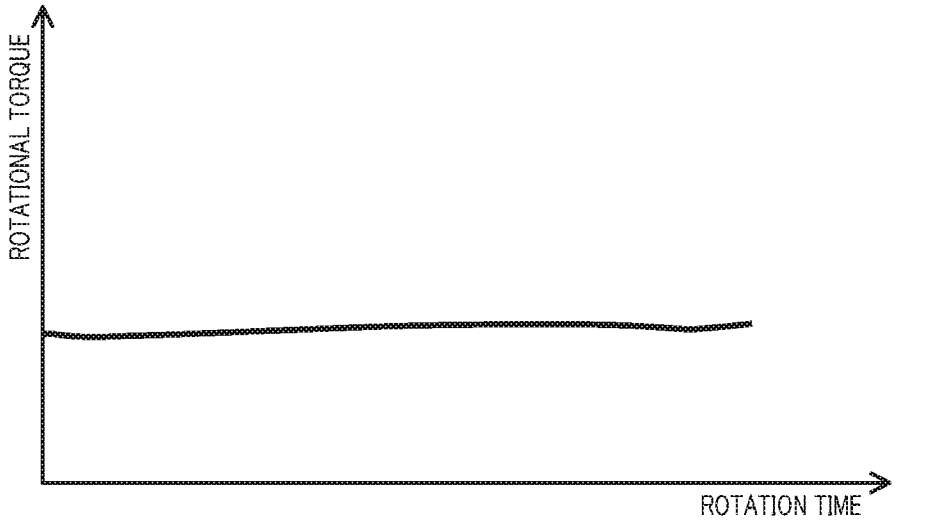
FIG. 7 illustrates a relationship between the rotation time of a lower pressure roller and the rotational torque.

In view of the above, in Modification 1, control section 101 controls cum driving motor 89 so as to rotationally drive cum member 86 in a direction of narrowing the nip width, that is, direction B2, corresponding to the magnitude of the rotational torque. Thereby, as illustrated in FIG. 7, even if thermal expansion occurs in upper pressure roller 63 or lower pressure roller 64, it is possible to maintain the rotational torque at a target value by not increasing the nip width. As a result, the nip width can be controlled with high accuracy. Even when normal paper is used as a recording medium (in the normal mode), the nip width and the torque are also in a proportional relationship as illustrated in FIG. 3, as in the envelope mode. Therefore, the nip width controlling method of Modification 1 is applicable even in the normal mode.

(Modification 2)

Figure 8:
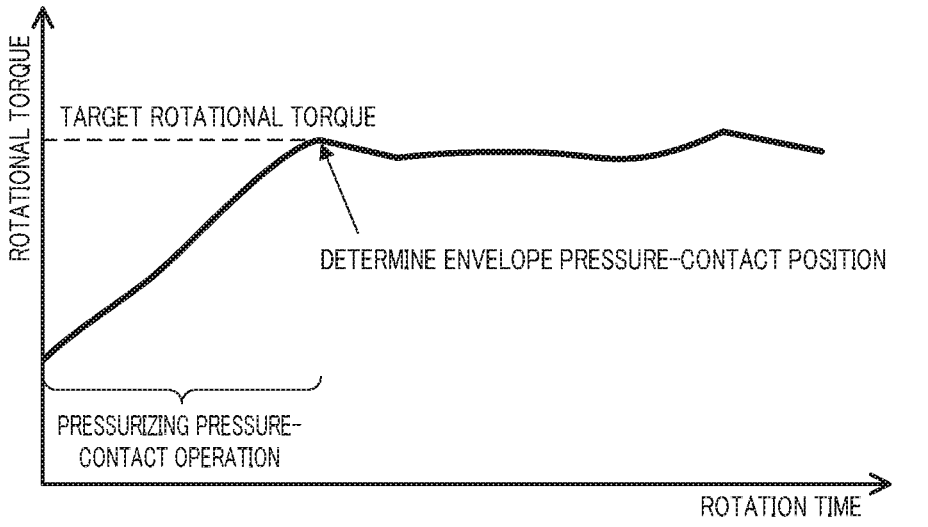
FIG. 8 illustrates a relationship between the rotation time of a lower pressure roller and the rotational torque.

Control of the nip width illustrated in FIG. 5 is performed after lower pressure roller 64 is moved to the pressure-contact position with upper pressure roller 63. In Modification 2, how to determine the pressure-contact position will be described with reference to FIG. 8. FIG. 8 illustrates a relationship between the rotation time of lower pressure roller 64 and the rotational torque. In FIG. 8, the horizontal axis shows rotation time (t) of lower pressure roller 64, and the vertical axis shows rotational torque (N·m). Note that in the description provided below, contact or pressure-contact of lower pressure roller 64 with upper pressure roller 63 via fixing belt 61 is referred to as "lower pressure roller 64 is in contact with, or in pressure-contact with, upper pressure roller 63". Further, in Modifications 2 to 5, "pressurizing pressure-contact" or "pressurizing pressure-contact operation" means "increasing the pressure in a pressure-contact state".

Control section 101 controls cum driving motor 89 so as to rotationally drive cum member 86 in direction B1 ("pressurizing pressure-contact operation" illustrated in FIG. 8). Torque sensor 81 detects the rotational torque during the pressurizing pressure-contact operation.

Control section 101 performs control to stop pressurizing pressure-contact operation when the rotational torque detected by torque sensor 81 reaches the target rotational torque (target value). Thereby, the pressure-contact position of lower pressure roller 64 in the envelope mode (envelope pressure-contact position) is determined. After the envelope pressure-contact position is determined, control section 101 performs control to maintain the rotational torque at a target value (control of nip width illustrated in FIG. 5).

(Modification 3)

Figure 9:
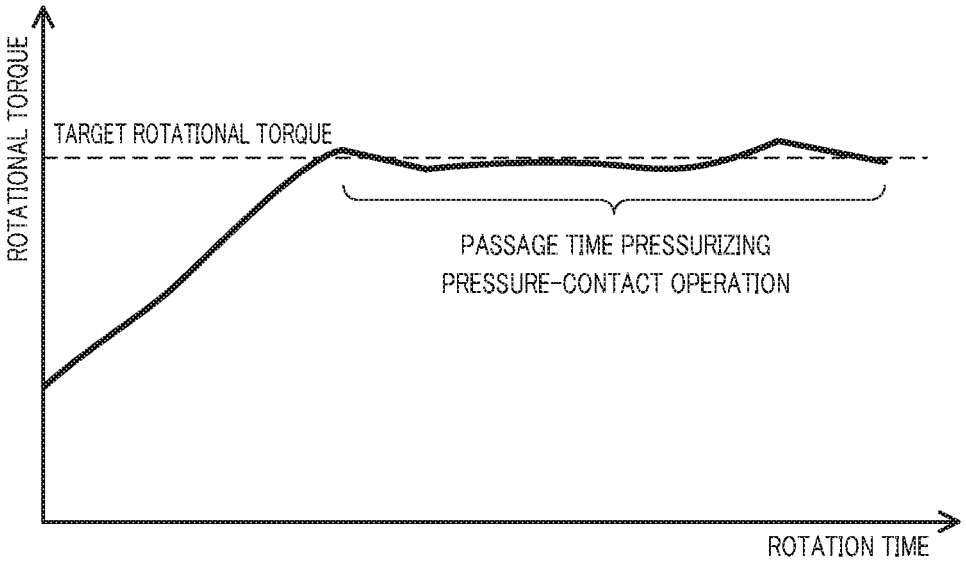
FIG. 9 illustrates a relationship between the rotation time of a lower pressure roller and the rotational torque.

Next, in Modification 3, control of the nip width in the envelope mode will be described with reference to FIG. 9. FIG. 9 illustrates a relationship between the rotation time of lower pressure roller 64 and the rotational torque. In FIG. 9, the horizontal axis shows rotation time (t) of lower pressure roller 64, and the vertical axis shows rotational torque (N·m).

As illustrated in FIG. 9, torque sensor 81 detects rotational torque when an envelope passes through. Control section 101 controls moving section 82 such that the rotational torque detected by torque sensor 81 is maintained at a target value ("passage time pressurizing pressure-contact operation" illustrated in FIG. 9).

It is not limited that detection of the rotational torque by torque sensor 81 is performed when the envelope passes. It can be performed as long as it is during a printing job, for example. For example, during the inter-sheet period showing a period from the time when an envelope passes through the fixing nip until the next envelope reaches the fixing nip, detection of rotational torque can be performed. Since the rotational torque in the inter-sheet period is more stabilized than the rotational torque in the sheet passage time, it is preferable to detect rotational torque in the inter-sheet period. In that case, control section 101 may control moving section 82 with use of a value of moving average of the rotational torque in the inter-sheet period.

(Modification 4)

Figure 10:
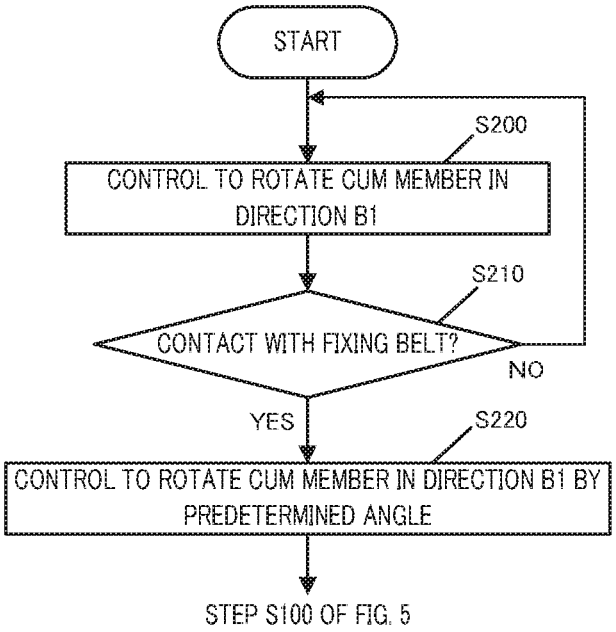
FIG. 10 is a flowchart illustrating an example of positioning control of an envelope pressure-contact position.

In the embodiment and the modifications described above, in order to determine the pressure-contact position of lower pressure roller 64 (envelope pressure-contact position), pressurizing pressure-contact operation is continued until the rotational torque becomes the target rotational torque (target position). However, the present invention is not limited thereto. In Modification 4, another method of determining an envelope pressure-contact position will be described with reference to FIG. 10. FIG. 10 is a flowchart showing an example of positioning control of an envelope pressure-contact position. This flow is realized by execution of a program recorded on ROM 103 by CPU 102 of control section 101. At the beginning of this flow, cum member 86 is at the rotational direction start position.

First, at step S200, control section 101 controls moving section 82 to rotate cum member 86 in direction B1.

Next, at step S210, control section 101 determines whether or not lower pressure roller 64 is brought into contact with fixing belt 61. When lower pressure roller 64 is in contact with fixing belt 61 (step S210: YES), the processing proceeds to step S220. When lower pressure roller 64 is not in contact with fixing belt 61 (step S210: NO), the processing returns to the process before step S200.

At step S220, control section 101 controls moving section 82 to rotate cum member 86 in direction B1 by a predetermined angle. Thereby, the envelope pressure-contact position is determined. Then, the processing proceeds to step S100 illustrated in FIG. 5, and the nip width is controlled.

(Modification 5)

Figure 11:
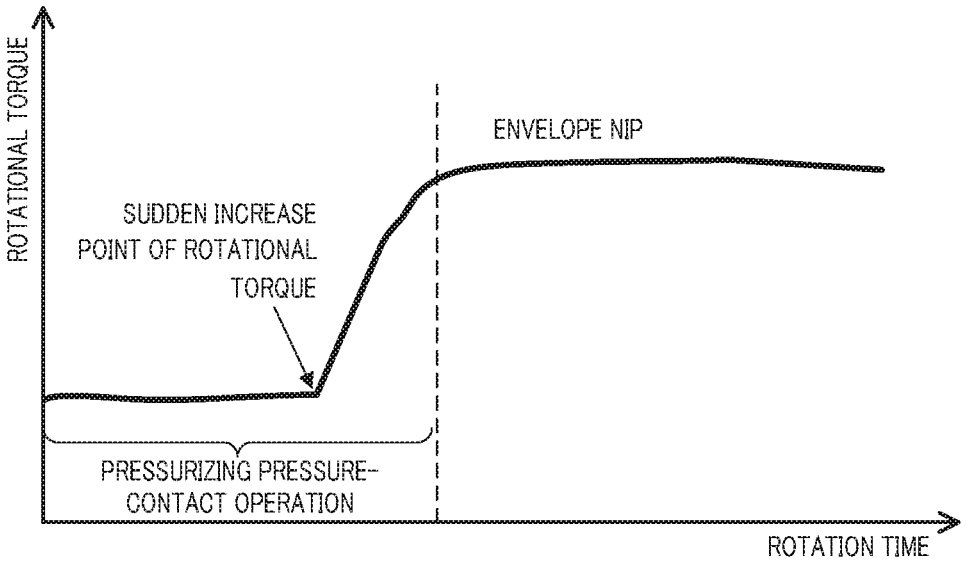
FIG. 11 illustrates a relationship between the rotation time of a lower pressure roller and the rotational torque.

In Modification 4 described above, at step S210 illustrated in FIG. 10, control section 101 determines whether or not lower pressure roller 64 is brought into contact with fixing belt 61. In Modification 5, the case where it is determined to be brought into contact with fixing belt 61 will be described with reference to FIG. 11. FIG. 11 illustrates a relationship between the rotation time of lower pressure roller 64 and the rotational torque. In FIG. 11, the horizontal axis shows rotation time (t) of lower pressure roller 64, and the vertical axis shows rotational torque (N·m).

During pressurizing pressure-contact operation illustrated in FIG. 11, when lower pressure roller 64 is brought into contact with fixing belt 61, the rotational torque of lower pressure roller 64 suddenly increases ("sudden increase point of rotational torque" in FIG. 11). When the rotational torque suddenly increases, control section 101 determines that lower pressure roller 64 is brought into contact with fixing belt 61. Then, when the rotational torque reaches the target rotational torque (target position), control section 101 performs control to maintain the rotational torque at a target value (control of nip width illustrated in FIG. 5).

Lower pressure roller 64 and upper pressure roller 63 move relative to each other in a direction of being brought into pressure-contact with each other or a direction opposite to the pressure-contact direction corresponding to the rotational angle of cum member 86, and accordingly, the nip width is changed. Therefore, it can be said that the rotational torque of lower pressure roller 64 and the driving torque of cum driving motor 89 are in a proportional relationship. Thus, it is possible to control the nip width on the basis of the driving torque of cum driving motor 89.

Figure 12:
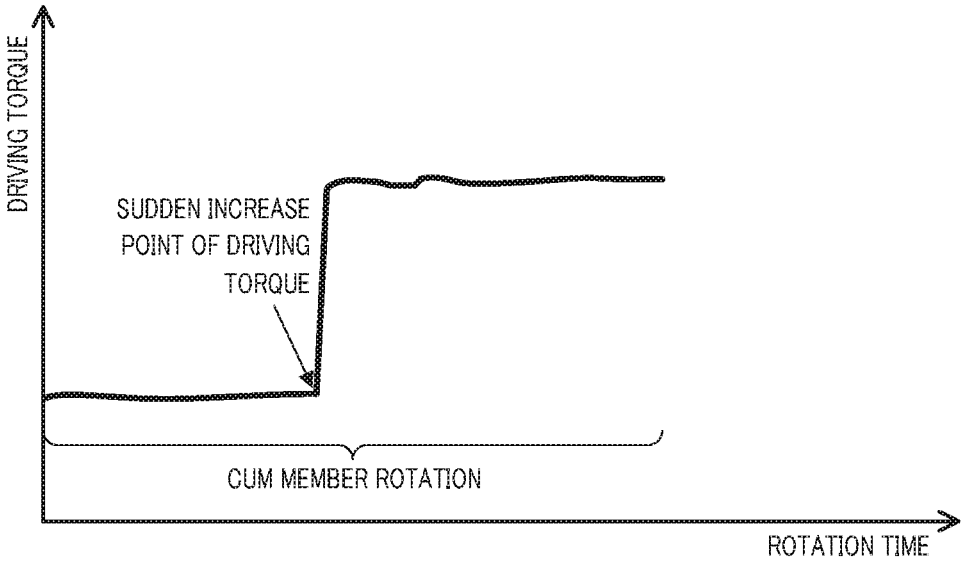
FIG. 12 illustrates a relationship between the drive torque of a cam drive motor and the rotation time of the cam drive motor.

FIG. 12 illustrates a relationship between the driving torque of cum driving motor 89 that rotates cum member 86 and the rotational time of cum driving motor 89. In FIG. 12, the horizontal axis shows rotation time (t) and the vertical axis shows driving torque (N·m). As illustrated in FIG. 12, when lower pressure roller 64 is brought into contact with fixing belt 61 ("sudden increase point of driving torque" in FIG. 12), the driving torque of the cum driving motor suddenly increases. When the driving torque suddenly increases, control section 101 determines that lower pressure roller 64 is brought into contact with fixing belt 61. Then, when the driving torque of cum driving motor 89 reaches the target driving torque (target position), control section 101 performs control to maintain the driving torque at a target value (control of nip width illustrated in FIG. 5).

(Modification 6)

In the modifications described above, determination of whether or not lower pressure roller 64 is brought into contact with fixing belt 61 is performed on the basis of a change in the rotational torque of lower pressure roller 64 and a change in the driving torque of cum driving motor 89. However, the present invention is not limited thereto.

Figure 13:
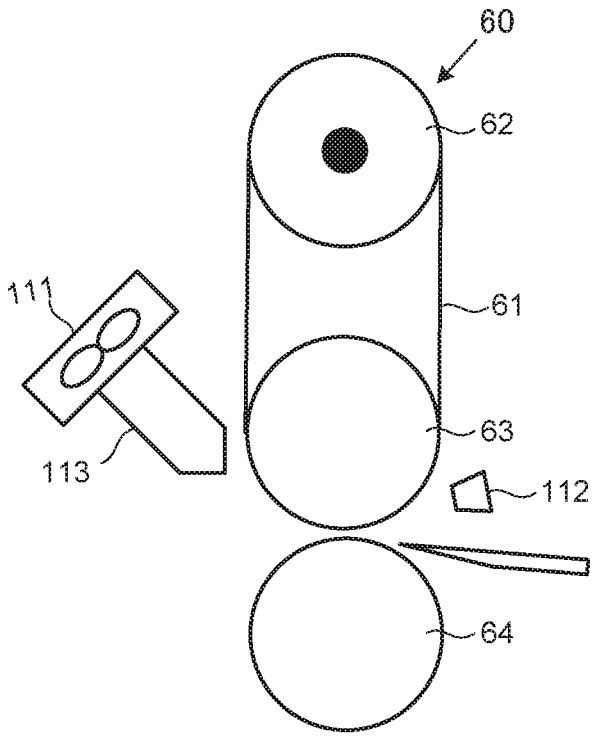
FIG. 13 is a diagram schematically illustrating a fixing section and the vicinity thereof.

Next, Modification 6 will be described with reference to FIG. 13. FIG. 13 schematically illustrates fixing section 60 and the vicinity thereof. As illustrated in FIG. 13, in the vicinity of fixing section 60, separation fan 111 (corresponding to "separator" of the present invention), air flow detection section 112, and nozzle 113 are disposed. Separation fan 111 is disposed on the downstream side, in the recording medium conveying direction, of the fixing nip. Separation fan 111 forms the air flow so as to separate an envelope from fixing belt 61.

Air flow detection section 112 is disposed on the upstream side, in the recording medium conveying direction, of the fixing nip.

Nozzle 113 throttles the air flow formed by separation fan 111. When lower pressure roller 64 is not in contact with fixing belt 61, the air flow reaches the upstream side, in the recording medium conveying direction, of the fixing nip. This means that air flow detection section 112 detects presence or absence of the air flow. Meanwhile, when lower pressure roller 64 is in contact with fixing belt 61, the air flow is blocked by the fixing nip and does not reach the upstream side in the recording medium conveying direction. This means that air flow detection section 112 does not detect the air flow.

When the air flow is not detected after the air flow has been detected by air flow detection section 112, control section 101 determines that lower pressure roller 64 is brought into contact with fixing belt 61.

(Modification 7)

Figure 14:
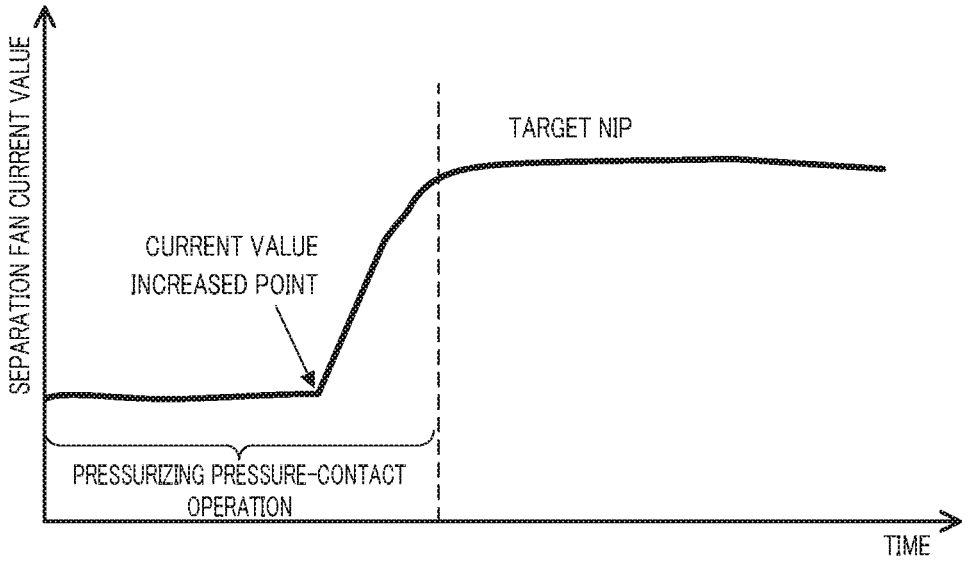
FIG. 14 illustrates a relationship between the electric current value of a separation fan and the time.

Next, as Modification 7, another method of determining whether or not lower pressure roller 64 is brought into contact with fixing belt 61 will be described. FIG. 14 illustrates a relationship between the electric current value of separation fan 111 and the time. In FIG. 14, the horizontal axis shows the time, and the vertical axis shows the electric current value of separation fan 111. A detection section, not illustrated, detects the flow amount of air flow by the separation fan. On the basis of the detection value of the flow amount of the air flow by the detection section, control section 101 controls electric current (electric power) supplied to separation fan 111 such that the air flow becomes a predetermined flow amount.

When lower pressure roller 64 is not in contact with fixing belt 61, the air flow passes through the gap between lower pressure roller 64 and fixing belt 61. At this time, the current value of the electric current supplied to separation fan 111 shows a low value. Meanwhile, when lower pressure roller 64 is brought into contact with fixing belt 61, since the air flow cannot pass through the gap between lower pressure roller 64 and fixing belt 61, air passage resistance is increased, whereby the flow amount of the air flow is decreased. At this time, in order to allow the air flow to be a predetermined flow amount, the increased amount of the current value of the electric current supplied to separation fan 111 exceeds a predetermined increased amount.

When the increased amount of the current value of the electric current supplied to separation fan 111 exceeds the predetermined increased amount ("electric current value increased point" shown in FIG. 14), control section 101 determines that lower pressure roller 64 is brought into contact with fixing belt 61.

(Modification 8)

In Modification 8, description will be given on the case of correcting the target value of the rotational torque on the basis of the length of an envelope in the conveying direction. Since an envelope is made up of doubled sheets, when the two sheets are shifted from each other during conveyance by fixing section 60, wrinkles may be generated. Regarding the shift during conveyance by fixing section 60, an accumulated shift becomes larger as the length in the conveyance direction of an envelope is longer, which tends to appear as wrinkles. Therefore, as the length of an envelope in the conveyance direction is longer, it is necessary to narrow the nip width. In order to secure strong fixity as possible, it is preferable to widen the nip width when the length in the conveyance direction is short. In view of the above, when the length of an envelope in the conveyance direction is long, the target rotational torque (target value) is reduced, while when the length is short, the target rotational torque is increased.

Figures 15, 16:
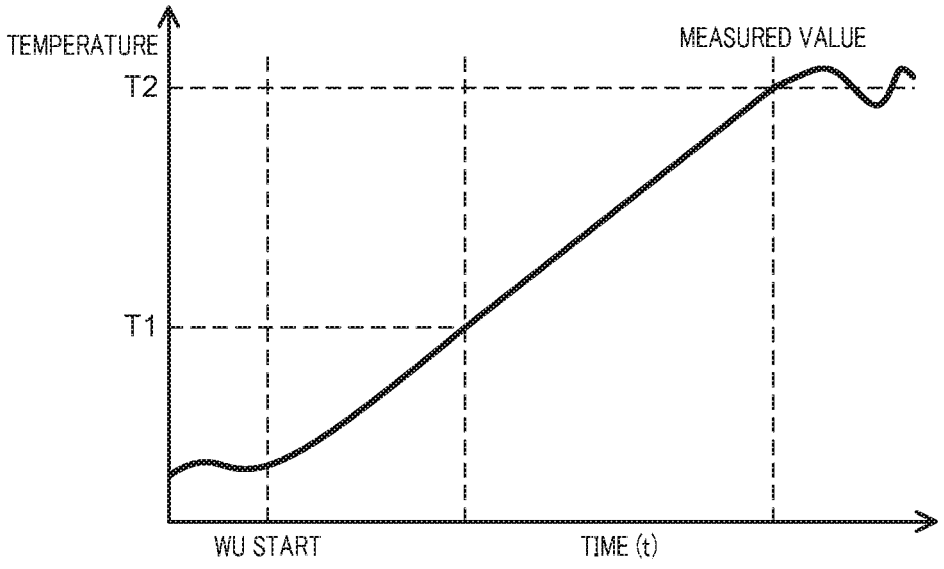
FIG. 15 illustrates a relationship between the length of an envelope in the conveyance direction and the target rotational torque.
FIG. 16 illustrates transition of the surface temperature of a fixing belt from the time of starting morning warmup.

FIG. 15 illustrates a relationship between the length of an envelope in the conveyance direction and the target rotational torque. FIG. 15 shows that the target rotational torque is increased corresponding to the length of the envelope in the conveyance direction. Control section 101 refers to the relationship between the length of the envelope in the conveyance direction and the rotational torque illustrated in FIG. 15 to perform control to allow the rotational torque detected by torque sensor 81 to become the target rotational torque (target value).

Note that in order to secure durable torque change in the fixing member (including fixing belt 61), it is possible to detect a change in the rotational torque in the normal mode and correct the target rotational torque (target value) in the envelope mode on the basis of the detected change rate of the rotational torque.

(Modification 9)

Next, Modification 9 will be described with reference to FIGS. 16 and 17. In Modification 9, description will be given on the case of correcting the target rotational torque (target value) on the basis of the surface temperature of fixing belt 61. FIG. 16 illustrates transition of the surface temperature of fixing belt 61 from the morning warmup (WU) start time. After the start of morning WU, at the point of time when the surface temperature of fixing belt 61 becomes a predetermined temperature T1, lower pressure roller 64 is brought into pressure-contact with fixing belt 61 at a predetermined pressure, and after the temperature rises to a temperature-control temperature T2, temperature is controlled.

Figure 17:
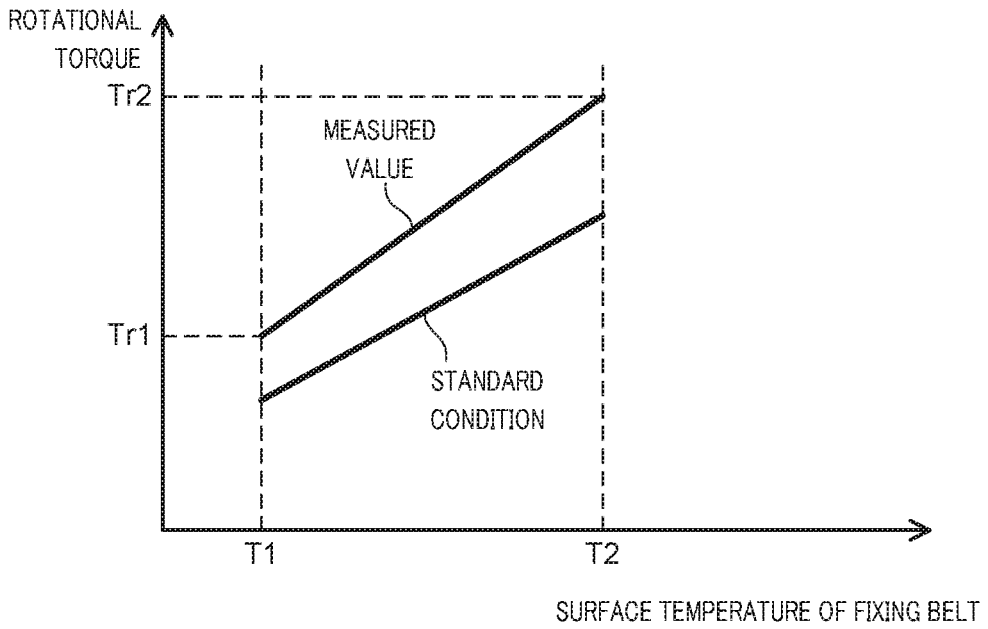
FIG. 17 illustrates a relationship between the surface temperature of a fixing belt at the time of morning warmup and the rotational torque.

FIG. 17 illustrates a relationship between the surface temperature of fixing belt 61 at the time of morning WU and the rotational torque. As illustrated in FIG. 17, when the surface temperature of fixing belt 61 rises from the predetermined temperature T1 to temperature-control temperature T2, the rotational torque is changed from Tr1 to Tr2. Accordingly, the variation amount (inclination) "a" of the rotational torque with respect to the surface temperature of fixing belt 61 is expressed by the following Expression (1).

$$a=(Tr2-Tr1)/(T2-T1) \quad (1)$$

Expression (1) shows the relationship between the surface temperature of the fixing member at the time of morning WU and the rotational torque.

Assuming that the inclination under the standard condition is a0, a correction rate r is expressed by the following Expression (2).

$$r=a/a0 \quad (2)$$

Note that the inclination a0 under the standard condition shows the relationship between the predetermined surface temperature of fixing belt 61 and the rotational torque.

Assuming that the rotational torque under the standard condition is Tr0, the target rotational torque (target value) is expressed by the following Expression (3).

$$Tr=Tr0*r \quad (3)$$

That is, on the basis of the relationship between the surface temperature of fixing belt 61 at the time of morning WU and the rotational torque, control section 101 corrects the target rotational torque (target value) with reference to the predetermined relationship between the surface temperature of fixing belt 61 and the rotational torque. Note that the predetermined relationship between the surface temperature of fixing belt 61 and the rotational torque (inclination a0 under the standard condition) is stored in the ROM of control section 101 at the time of shipping of the product, for example.

(Modification 10)

In Modification 8 described above, description has been given on the case of correcting the target rotational torque (target value) on the basis of the length of an envelope in the conveying direction. Further, in Modification 9 described above, description has been given on the case of correcting the target rotational torque (target value) on the basis of the surface temperature of fixing belt 61.

Figure 18:
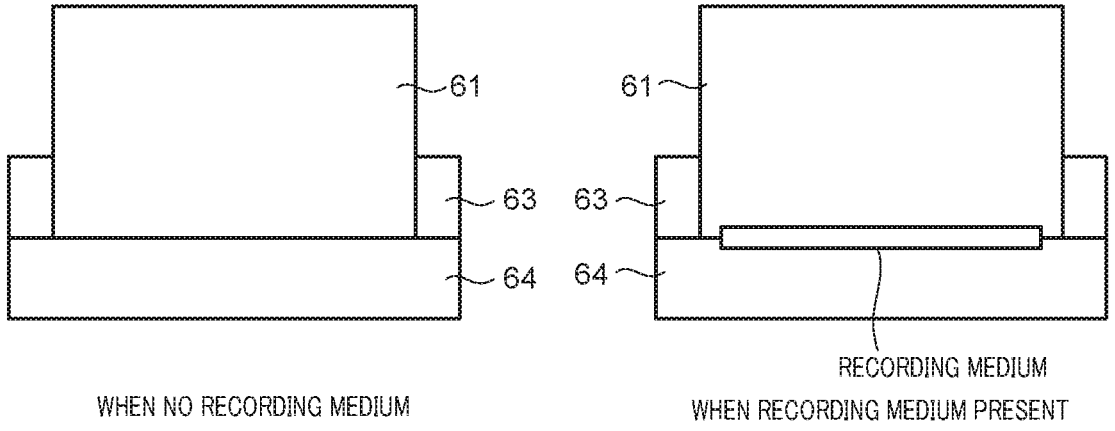
FIG. 18 illustrates a state of deformation of a fixing member.

In modification 10, the case of correcting the target rotational torque (target value) on the basis of information regarding a recording medium (sheet thickness, for example) will be described with reference to FIGS. 18 to 22. FIG. 18 illustrates deformation states of pressure rollers 63 and 64 in the fixing nip, depending on presence or absence of a recording medium in a nip state. As illustrated in FIG. 18, when a recording medium is present in the fixing nip, the deformation amounts of pressure rollers 63 and 64 of the portions where a recording medium is present are larger than the deformation amounts of pressure rollers 63 and 64 of the portions where a recording medium is not present. Therefore, the rotational torque (here, rotational torque for rotating roller 63) is also increased.

Figure 19:
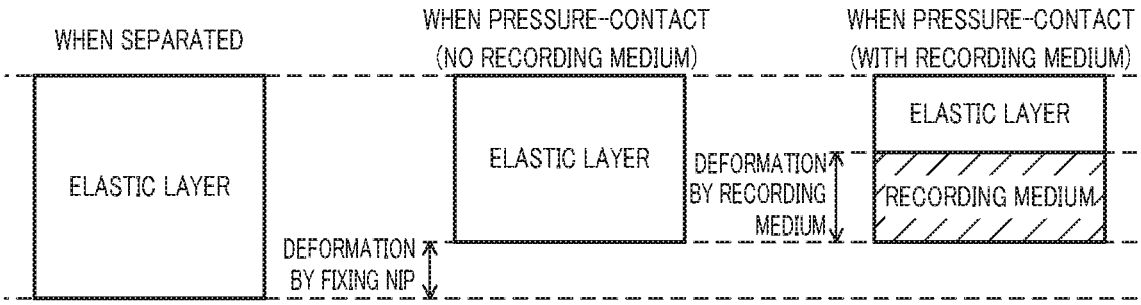
FIG. 19 illustrates a state of deformation of a fixing member in the fixing nip.

FIG. 19 illustrates deformation states of pressure rollers 63 and 64 in the fixing nip. As illustrated in FIG. 19, relative to the time when pressure rollers 63 and 64 are spaced apart from each other, the elastic layer is compressed by the pressure-contact between pressure rollers 63 and 64, and further, since a recording medium is present, the compressed amount of the elastic layer is increased.

Figure 20:
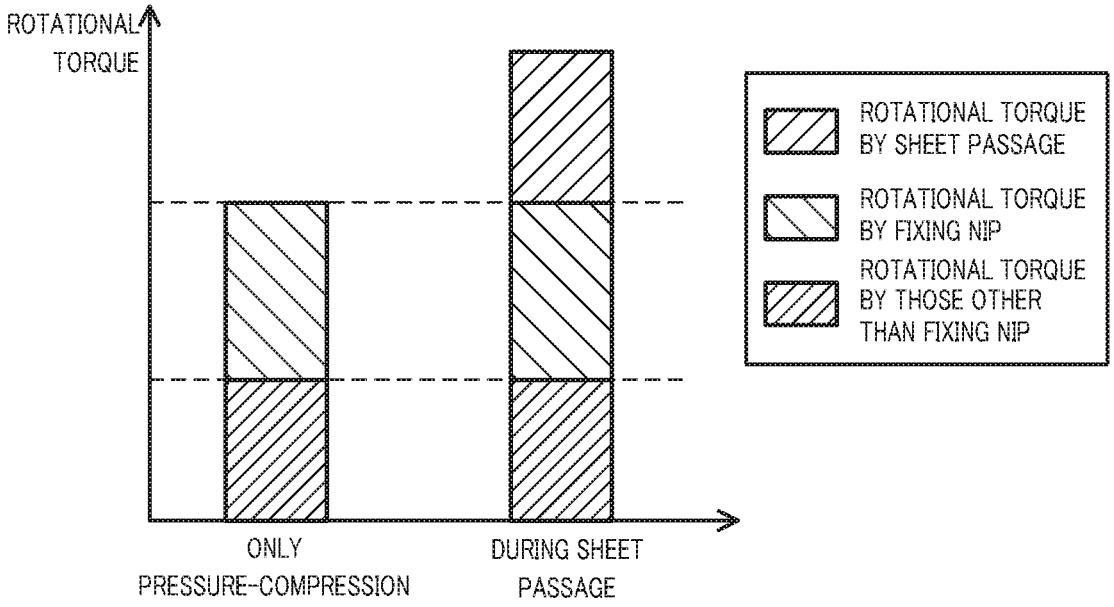
FIG. 20 illustrates the rotational torque when an upper pressure roller and a lower pressure roller are in pressure-contact with each other.

FIG. 20 illustrates the rotational torque when pressure rollers 63 and 64 are in pressure-contact with each other. Rotational torque includes torque caused by deformation of pressure rollers 63 and 64 in the fixing nip, torque for driving the roller driving motor itself that drives lower pressure roller 64, and torque due to durability change such as deterioration of bearings. Further, during when a recording medium passes through the fixing nip, the deformation amounts of pressure rollers 63 and 64 in the fixing nip are increased, whereby the rotational torque is increased.

Figure 21:
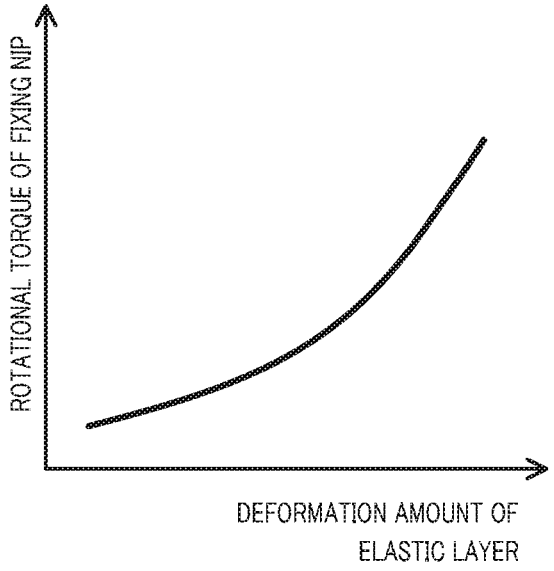
FIG. 21 illustrates a deformation amount of an elastic layer of a fixing member and the rotational torque generated in the fixing nip.
Figure 22:
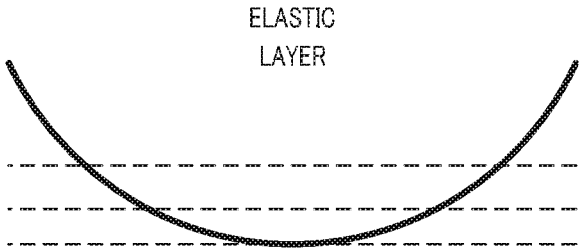
FIG. 22 illustrates a deformation amount in a stepwise manner when an elastic layer of a fixing member is crushed due to passage of a sheet.

FIG. 21 illustrates deformation amount of the elastic layer of pressure rollers 63 and 64 and the torque generated in the fixing nip. FIG. 22 illustrates a change amount in a stepped manner when the elastic layer is crushed by the fixing nip or sheet passage, with use of pressure roller 63 as an example. As illustrated in FIG. 21, as the change amount of the elastic layer increases, the increased amount of the rotational torque in the fixing nip increases. This is because as the change amount of the elastic layer increases, the crushed amount of the elastic layer increases, as illustrated in FIG. 22.

Figure 23:
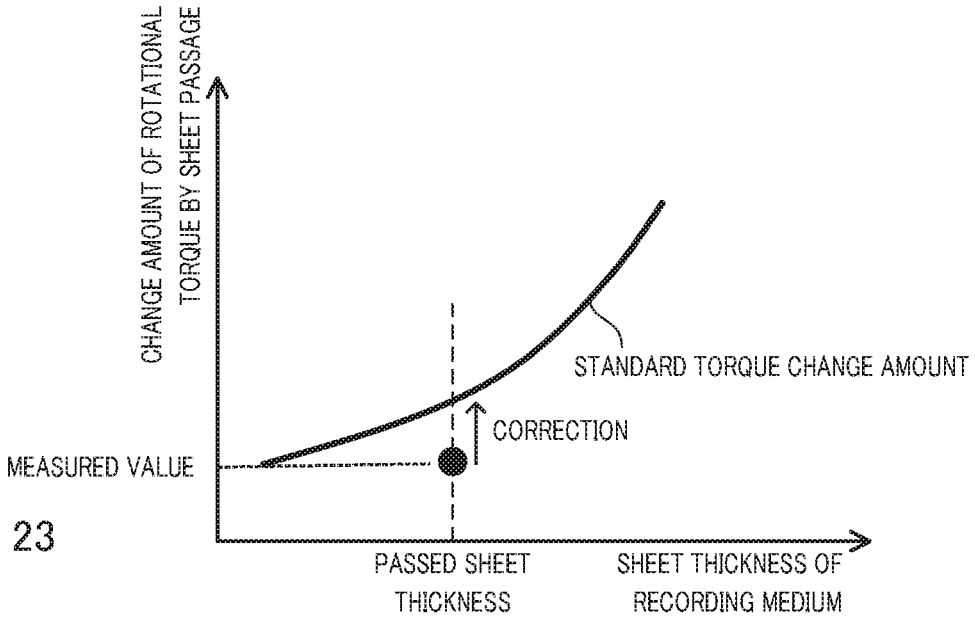
FIG. 23 illustrates a relationship between the sheet thickness of a recording medium and a change amount of the rotational torque due to passage of a sheet.

Therefore, even in the case where a recording medium of the same thickness is passed through, the change amount of the rotational torque varies corresponding to the change amount of the elastic layer. The relationship between the thickness of a recording medium that passes through and a standard change amount of the rotational torque is determined (standard torque change amount illustrated in FIG. 23). By referring to this relationship, it is possible to know the current nip width from the change amount of the rotational torque by the actual passage of a sheet. Note that control section 101 acquires thickness information of the recording medium from a media sensor provided to the main body of image forming apparatus 1. On the basis of the thickness information of the recording medium, control section 101 changes the moving amount of lower pressure roller 64 to thereby control cum driving motor 89 so as to allow the rotational torque at the time of sheet passage to be the standard torque change amount. According to the nip width controlling method of Modification 10, it is possible to control the nip width with high accuracy even if there is a torque change by a cause other than the fixing nip (see FIG. 20).

INDUSTRIAL APPLICABILITY

The present invention is preferably applicable to an image forming apparatus having a fixing apparatus required to prevent degradation of the fixing quality by controlling the nip width with high accuracy.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing apparatus, comprising:

a pair of fixing members, the pair of the fixing members being in pressure-contact with each other and at least one of the pair of the fixing members rotating to form a fixing nip, the fixing nip sandwiching and conveying a recording medium;

a mover that moves the pair of the fixing members relative to each other in a direction in which the pair of the fixing members are brought into pressure-contact with each other or a direction opposite to the direction in which the pair of the fixing members are brought into pressure-contact with each other;

a detector that detects rotational torque for rotating any one of the pair of the fixing members; and a hardware processor that controls the mover such that the pair of the fixing members are moved relative to each other corresponding to the detected rotational torque.

2. The fixing apparatus according to claim 1, wherein the recording medium is an envelope.

3. The fixing apparatus according to claim 2, wherein the hardware processor controls the mover to move the pair of the fixing members relative to each other corresponding to a length of the recording medium in a conveying direction of the recording medium.

4. The fixing apparatus according to claim 3, wherein the hardware processor controls the mover to increase a moving amount of the pair of the fixing members that are moved relative to each other in the direction opposite to the direction in which the pair of the fixing members are brought into pressure-contact with each other, as the length of the recording medium in the conveying direction of the recording medium is longer.

5. The fixing apparatus according to claim 1, wherein the detector detects the rotational torque when the pair of the fixing members are moved relative to each other by the mover in a direction in which the pair of the fixing members are brought into pressure-contact with each other or a direction opposite to the direction in which the pair of the fixing members are brought into pressure-contact with each other, and the pair of the fixing members are in pressure-contact with each other in a pressurized manner, and the hardware processor controls the mover so as to stop relative movement of the pair of the fixing members when the detected rotational torque reaches a target value.

6. The fixing apparatus according to claim 1, wherein the detector detects the rotational torque during execution of a printing job.

7. The fixing apparatus according to claim 6, wherein the detector detects the rotational torque between sheets.

8. The fixing apparatus according to claim 1, wherein the detector detects the rotational torque after the pair of the fixing members are moved relative to each other from a position at which the pair of the fixing members are in contact with each other in a direction in which the pair of the fixing members are brought into pressure-contact with each other.

9. The fixing apparatus according to claim 8, wherein the position at which the pair of the fixing members are in contact with each other is a position at which the pair of the fixing members are brought into contact with each other from a separated state.

10. The fixing apparatus according to claim 9, wherein the rotational torque is torque to be applied to a driving motor that rotates any one of the pair of the fixing members.

11. The fixing apparatus according to claim 8, further comprising:

a separator disposed on a downstream side of the fixing nip in a conveying direction of the recording medium, the separator forming an air flow for separating the recording medium from the fixing member; and an air flow detector disposed on an upstream side of the fixing nip in the conveying direction, the air flow detector detecting the air flow that passes through between the pair of the fixing members, wherein the position at which the pair of the fixing members are in contact with each other is a position in a state where the air flow is not detected by the air flow detector.

12. The fixing apparatus according to claim 8, further comprising a separator disposed on a downstream side of the fixing nip in a conveying direction of the recording medium, the separator forming an air flow for separating the recording medium from the fixing member, wherein the hardware processor controls a driving electric current of the separator for changing an air flow amount of the separator, and the position at which the pair of the fixing members are in contact with each other is a position when a change amount per hour of the driving electric current exceeds a predetermined change amount.

13. The fixing apparatus according to claim 1, wherein the hardware processor corrects rotational torque with respect to surface temperature of the fixing member at a warmup time, on a basis of a predetermined relationship between the surface temperature of the fixing member and the rotational torque.

14. The fixing apparatus according to claim 1, wherein the hardware processor corrects rotational torque with respect to a thickness of the recording medium, on a basis of a predetermined relationship between the thickness of the recording medium and the rotational torque.

15. The fixing apparatus according to claim 1, wherein the hardware processor corrects the detected rotational torque on a basis of a predetermined relationship between a thickness of the recording medium and rotational torque, and controls the mover such that the pair of the fixing members are moved relative to each other corresponding to the corrected rotational torque.

16. An image forming apparatus, comprising:

an image former that forms an image on a recording medium; and the fixing apparatus, according to claim 1, that fixes the image formed by the image former on the recording medium.

17. A nip width controlling method in a fixing apparatus having a pair of fixing members, the pair of the fixing members being in pressure-contact with each other and at least one of the fixing members rotating to form a fixing nip, the fixing nip sandwiching and conveying a recording medium, the method comprising:

detecting rotational torque for rotating any one of the pair of the fixing members; and moving the pair of the fixing members relative to each other in a direction in which the pair of the fixing members are brought into pressure-contact with each other or a direction opposite to the direction in which the pair of the fixing members are brought into pressure-contact with each other, corresponding to the rotational torque detected.

* * * * *